US007479075B2

(12) United States Patent
Burruss, Jr.

(10) Patent No.: US 7,479,075 B2
(45) Date of Patent: Jan. 20, 2009

(54) PITCHER'S CATCHER

(76) Inventor: Norman Welch Burruss, Jr., 11500 Brock Road, Spotsylvania, VA (US) 22553

( * ) Notice: Subject to any disclaimer, the term of this patent is extended or adjusted under 35 U.S.C. 154(b) by 246 days.

(21) Appl. No.: 11/436,343

(22) Filed: May 18, 2006

(65) Prior Publication Data

US 2007/0270250 A1 Nov. 22, 2007

(51) Int. Cl.
*A63B 69/00* (2006.01)

(52) U.S. Cl. ..... 473/454

(58) Field of Classification Search ..... 473/421, 473/432, 434–436, 446, 454, 456; D21/780, D21/715, 717

See application file for complete search history.

(56) References Cited

U.S. PATENT DOCUMENTS 1,056,909 A * 3/1913 King ..... 2/19
1,170,715 A * 2/1916 Westgate ..... 473/432
1,567,384 A 12/1925 Rectenwald
3,001,790 A 9/1961 Pratt
3,197,208 A * 7/1965 Makar ..... 473/190
4,254,952 A 3/1981 Playter
4,275,883 A 6/1981 Grimaldi et al.
4,344,621 A 8/1982 Baker
D276,466 S * 11/1984 Giovagnoli ..... D25/1
4,497,485 A 2/1985 Macosko
4,629,188 A * 12/1986 Mahieu ..... 473/454
5,222,731 A 6/1993 Hanabusa et al.
D354,992 S * 1/1995 Hinsperger ..... D21/705
5,433,434 A * 7/1995 Helmetsie ..... 473/446
5,439,211 A 8/1995 Drabowski
5,452,896 A * 9/1995 Core ..... 473/164
5,573,240 A 11/1996 Humboldt
5,672,125 A 9/1997 Ross
5,803,842 A * 9/1998 Ross ..... 473/456
6,878,078 B2 * 4/2005 Swanson ..... 473/454
2007/0270250 A1 * 11/2007 Burruss ..... 473/454

* cited by examiner

*Primary Examiner*—Gene Kim
*Assistant Examiner*—M Chambers
(74) *Attorney, Agent, or Firm*—Eugene H. Eickholt

(57) ABSTRACT

A training device is disclosed particularly adapted to assist a baseball pitcher in developing accuracy and controlling the velocity of his pitches. The device provides an adjustable strike zone comprising a real catcher's mitt. A velocity meter that records the actual velocity of the pitched ball is an additional feature. Also, there is a net and frame apparatus that stops pitches, including a trough to collect pitched baseballs. The entire apparatus is portable, and can be disassembled and reassembled at any desired site.

9 Claims, 1 Drawing Sheet

PITCHER'S CATCHER

BACKGROUND OF THE INVENTION

1. Field of the Invention

The present invention relates to baseball pitching targets and in particular to a padded leather catcher's mitt which provides the sound of a ball being pitched into a catcher's mitt and also produces instant feedback of the velocity of the pitch both inside and outside of the strike zone.

2. Description of the Related Art

Pitching is one of the most important aspects of the game of baseball. A good pitcher can win the game for a team. The pitcher is also the one who is constantly watched by the fans. Accuracy in pitching is a must and requires considerable practice to achieve the skill necessary to perform successfully as a pitcher.

Most pitchers do not have a catcher constantly available to allow them the amount of time required to develop and maintain a high level of expertise. While some other pitching targets have been developed to provide pitchers an opportunity to practice they often fall short of optimum effectiveness because some do not provide instant feedback about the exact velocity of the pitch, others are overly complex and expensive, and none provide the actual feel of pitching to a catcher because of the premium and realistic sound effect caused by the impact of the ball into the leather target. U.S. Pat. No. 5,573,240 issued Nov. 12, 1996 to Humboldt, discloses a baseball backstop for stopping baseballs thrown at the backstop and for audibly indicating whether a thrown ball has hit the backstop in a strike zone comprises a frame, a netting attached to the frame, a piece of material placed directly in front of the netting and attached to the netting and/or the frame, the piece of material is a relatively heavy deformable piece of material, such that when a thrown ball hits the piece of material, a popping or thumping noise is made by the ball hitting the piece of material indicating that the thrown ball is a "strike", the thrown ball is stopped by the piece of material and falls to the ground in an area proximate to the frame for easy retrieval of the thrown ball, the netting is made of a meshed material such that when a thrown ball hits the netting alone, and not the piece of material, no popping or thumping noise is made indicating that the thrown ball is a "ball" and the thrown ball is stopped by the netting and falls to the ground in an area proximate to the frame for easy retrieval of the thrown ball.

U.S. Pat. No. 4,497,485 issued Feb. 5, 1985 to Macosko, shows a baseball pitching target comprising a rectangular peripheral tubular frame supported by support members staked to the ground and having a mesh backstop itself having an insert that represents such target indicia as the catcher's chest protector, shoulder pads, knee protector pads, and mitt. Pitched balls are collected in a compartmentalized ball receiving bag except for those pitched balls that miss the strike zone. Those missing the strike zone will be projected back toward the pitcher by the action of the spring-mesh structure of the backstop.

U.S. Pat. No. 4,344,621 issued Aug. 17, 1982 to Baker, shows a device for use in the practice of those sports involving the hurling or striking of a ball or other sport projectile toward a specified target. The device of the invention serves to safely arrest the flight of the projectile while informing the user of the exact point of impact of the projectile relative to a defined target zone. The target is a polymeric foam mat having a polymeric sheet bonded to its front face. The sheet removably carries target indicia. Apertures through the foam mat make up 40 to 50 percent of the total surface area of the mat. When a projectile strikes the sheet, an indentation, which lasts from 5 to 60 seconds, indicates the point of impact.

U.S. Pat. No. 4,275,883 issued Jun. 30, 1981 to Grimaldi, et al., is for a pitching target with ball return which indicates whether a baseball pitch is either a strike or a ball and, if a strike, the location of the strike, i.e.: outside corner. The ball return includes an inclined ball collecting trough for return of the thrown ball to the pitcher for reuse. The target includes a frame which supports a series of flap panels suspended in the same plane and within the frame. The panels are arranged in three rows and three columns. The panels in the central column are wider in the horizontal dimension than the two outside panels but have the same vertical dimension as the panels on each side thereof.

U.S. Pat. No. 3,001,790 issued Sep. 26, 1961 to Pratt, claims an improved target for baseball and softball pitchers that allows a ball to rebound in the manner expected of a batted ball according to the whether the pitch is high, low, inside, outside or in the center. It provides an average strike zone that includes a planar portion centrally of the target and is bounded by rearwardly inclined border portions or panels.

U.S. Pat. No. 4,254,952 issued Mar. 10, 1981 to Playter, shows a pitching practice device consisting of a sheet of canvas or the like supported in a vertical plane, and having an aperture formed therein defining a strike zone, at which a baseball pitcher may pitch baseballs to develop his accuracy and control. For still greater accuracy and control, and to "catch" the balls, a canvas chute is attached to the rearward surface of the sheet, and divided into a plurality of sections each opening through the sheet aperture, for receiving and trapping any ball entering its opening. The sheet aperture is thus divided into zones for indicating, and recording, whether a pitched ball is "high", "low", "inside", "outside", or "down the middle". The sheet is resiliently supported to prevent damage either to the device or to the ball. The device may also be adapted for use, with a set of playing rules, as a competitive game, particularly for children.

U.S. Pat. No. 1,567,384, issued Dec. 29, 1925 to Rectenwald, is for a pitching target that tilts to rebound the ball at different angles. It mentions a resilient portion of the strike zone target, which may be sandwiched behind a panel or on the front surface. Canvas may be stretched over the target strike zone and a coating of calcimine or other material covering the strike zone so that the point of contact of the ball would be visible.

U.S. Pat. No. 5,439,211 issued Aug. 8, 1995 to Drabowsky, indicates a target training system and method for baseball pitchers employing a target sheet mounted on a supporting structure so that a facing surface of the target sheet is vertical and a bottom of the target sheet is at ground level. Hitter shoulder level, waist level, and knee level lines are provided on the facing surface of the target sheet. First and second vertical boundary lines running from a top to a bottom of the sheet indicate a width of a strike zone. A plurality of boxes of differing colors and having differing sequencing indicia representing relatively high quality pitches are arranged in and around the strike zone. Regions having a white color within and near the strike zone and exclusive of the colored boxes are provided, the regions being exclusionary zones representing relatively poor quality pitches. Some of the boxes are subdivided to permit pitching to progressively smaller targets. Separate target sheets are provided for different skill levels.

U.S. Pat. No. 5,672,125 issued Sep. 30, 1997 to Ross, shows a pitcher's practice cage consisting of a compactly-foldable fabric-covered tubular structure which provides a large ball-gathering area, within which hangs a target marked with areas whose striking "calls" the pitch, and a ball-collecting sloping back wall and floor which accumulates pitched balls. Bows which support the canvas cover, one bow rigidly-mounted on short left-and-right support members hinge-mounted closely adjacent to the bow so rigidly supported, permit the entire structure to be folded into a flat "package" for moving and storing.

U.S. Pat. No. 5,222,731 issued Jun. 29, 1993 to Hanabusa, claims a device for catching a ball comprising a frame member constructed on the ground or the like, a net member put on the frame member, a mat member disposed substantially at the central part of the net member, the mat member having a strike zone defined thereon, a detection means for detecting the position of a pitched ball in the strike zone, and a display means for displaying the detected position of the ball. When the pitched ball collides with or passes through the strike zone, the detection means detects the colliding or passing position and has a judgment passed on the pitched ball as to whether it is a strike or ball in accordance with a baseball rule, and the judgment is displayed by the display means. Some devices for catching a ball further comprise a base member permitting the total weight of the device to be arbitrarily varied with a ballast such as water, sand, steel ball or the like, a pitch target shiftable after every pitch, and/or a ball return system for automatically returning the pitched ball to the pitcher.

What is needed is an inexpensive yet effective way to simulate the realistic and dynamic sound effect of pitching into a catcher's mitt with a clear indication of premium areas related to the strike zone and with instant feedback on the precise location of each pitch.

BRIEF DESCRIPTION OF THE FIGURE

FIG. 1 shows a perspective view of the combination of a genuine catcher's mitt, backstop and baseball return.

BRIEF SUMMARY OF THE INVENTION

Figure 3:
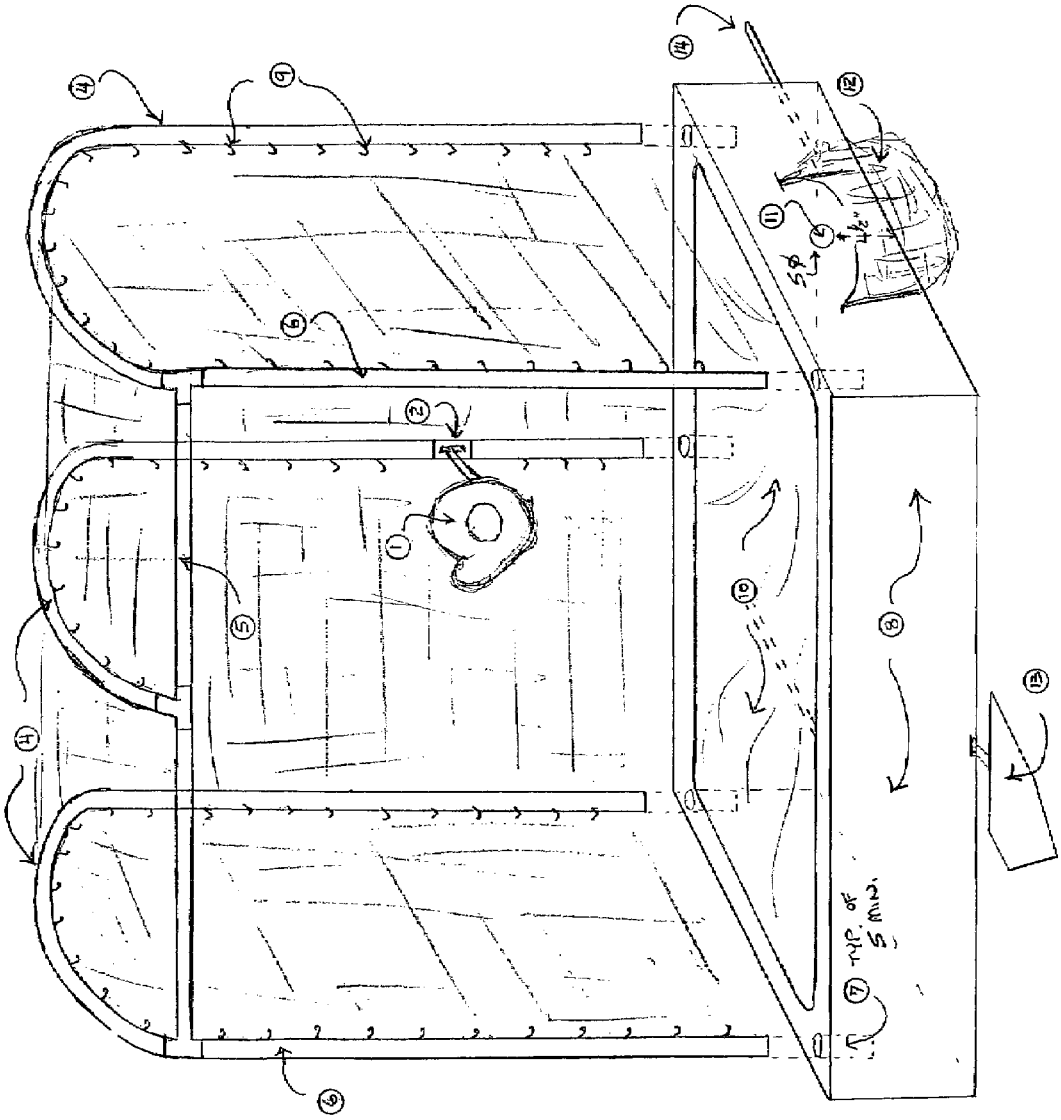

This invention is a device to allow a pitcher to mimic both the sound and the location of a catcher's mitt during practice when another person is not available to catch the thrown balls. It improves on the present art by not only providing instant visual feedback as to the location and velocity of the pitch, but by providing authentic auditory feedback from the sound of the pitched baseball striking the leather catcher's mitt.

A portable tubular frame assembly supports a net that stops the pitches that miss the catcher's mitt. The mitt is suspended above the ground at a height so as to imitate the presence of an actual catcher. The frame assembly is supported by a molded plastic base where the bottom tapers towards a trough. Pitched balls are stopped by the net or mitt, drop, and roll towards the trough where they are collected in a net external of the plastic base.

DETAILED DESCRIPTION OF THE INVENTION

Referring to FIG. 1, a standard catcher's mitt (1) is supported by an aluminum tubular frame member (2). Aluminum is the preferred material due to its light weight and inherent strength, but it is understood that any material of suitable strength may be substituted. Other suitable materials include metals, plastics, plastic composites such as fiber glass reinforced graphite, or even wood. Catcher's mitt (1) is hingedly supported onto tubular frame member (2) through a spring loaded mechanism, enabling the catcher's mitt to resiliently recoil, absorbing the kinetic energy of the pitched baseball as the catcher's mitt recoils in response to the pitched baseball. Such hinged mechanisms are well known in the art and the invention is not limited to a particular embodiment of the energy absorbing recoil apparatus.

Catcher's mitt (1) is attached to tubular member (2) through a coaxial sleeve that overlies the tubular member (2) in an adjustable fashion. There is a set screw or other detent mechanism that securedly fixes the catcher's mitt at the selected height, while enabling easy adjustment. In this manner, the height of the catcher's mitt can be fully adjusted to simulate the wide range of strike zones defined by batters of different heights.

Tubular frame member (2) is interconnected to semi-circular tubular frame member (4). Standard male/female connectors are contemplated, such as commonly utilized with tent poles or portable screen houses. Three upright support frame members are shown in the figure, although more may be provided should they be desired. On both sides of the center supporting frame member, to which is attached the catcher's mitt, end supporting members are provided. Also, a horizontal top supporting member (5) is attached to the semi-circular supporting members that straddle over the device and connect to two terminal vertical supporting frame members (6). Frame members (6) are located in the front of the frame and attach to the two end semi-circular frame members (4) and the horizontal frame support member (5) with male/female connectors. A three way male/female connector is provided on the terminal, end supports (6) to connect the semi-circular frame members (4) to both the horizontal support member (5) and the two vertical support frame members (6).

Vertical tubular support frame members (2) are removably inserted into corresponding registered holes (7) found in a supporting molded plastic base (8). Plastic is the preferred material for base member (8), because it is lightweight and relatively inexpensive. It is expressly understood, however, that other materials known to the ordinary artisan are appropriate, such as wood, metal, or polymer composites including fiber glass or graphite fiber reinforced composites. In Figure (1) five registered holes are provided. One hole is located at each corner of molded plastic base (8) and a fifth hole is located in the center of the back side of frame member (8) to support the center aluminum tubular frame member (2) that supports the catcher's mitt (1). The vertical tubular aluminum frame members (2) and (6) are removably registered into holes (7) affording easy disassembly and reassembly of the pitcher's catcher companion at any desired location.

Eye hooks (9) are intermittently positioned along all the tubular support frame members. These eye hooks (9) attach to a netting material that is provided with grommets that correspond in position with the eye hooks. Other suitable attachment means are contemplated, such as Velcro ® fasteners that are well known in the art of fasteners. The invention is not limited to any particular fastener between the tubular supporting frame members and the netting material.

Molded plastic base (8) has a bottom that tapers towards a central trough (10) that collects pitched baseballs. Balls that are stopped by either the catcher's mitt or the netting drop into the molded plastic base (8) and roll by gravity towards the central trough (10), which is the lowest point in height of the plastic base bottom portion. Further, the central trough (10) tapers downward towards opening (11). In this way, pitched baseballs will collect into net (12) and be readily retrievable at intermittent times. The action of the trough (10) and net (12) is much the same as conventional pool tables.

A representative "home plate" (13) is designed to snap into place onto the front of plastic base (8) through any appropriate mechanical fastening means. The particular fastening means is not critical, so long as the home plate (13) does not loosen from the plastic base (8) by vibration or otherwise. Velcro® or other means are contemplated. The purpose of the home plate is to provide a realistic target that simulates an actual batter and home plate.

Behind molded plastic base (8) are two or more horizontal snap-on stabilizers (14). The stabilizers (14) extend behind the plastic base (8) and provide support opposing backward rotation of the invention when the kinetic energy of a pitched baseball is absorbed. The supports are approximately two feet in length, but the device is not limited to any particular size.

The invention is further provided with a radar mechanism that measures the velocity of pitched baseballs, whether they enter the strike zone or otherwise. A conventional radar gun is utilized. Such devices are well known in the art; any appropriate radar gun that can measure velocity in the range of pitched baseballs is usable with the invention.

While specific objects and features of the subject invention have been disclosed in full detail herein, it will be readily understood that the invention encompasses all modifications and enhancements within the scope and spirit of the following claims.

What is claimed is:

1. A baseball training device comprising a standard catcher's mitt supported to a frame member with a spring loaded hinge mechanism, whereby the catcher's mitt recoils when absorbing kinetic energy from a pitched baseball, and whereby the catcher's mitt emits a sound corresponding to a genuine baseball contacting a real pitcher's mitt, further including a frame means which surrounds the catcher's mitt, frame member and hinge mechanism, and a net means attached to the frame means whereby pitched baseballs that miss the catcher's mitt are stopped and captured wherein the frame means is supported by a portable base, which further includes a trough that channels pitched baseballs and a collection net in register with the trough that collects pitched baseballs and wherein the portable base is provided with stabilizers to provide support opposing backward rotation of the baseball mechanism when pitched baseballs are stopped.

2. The baseball training device of claim 1 further including a velocity meter that both measures and records the velocity of pitched baseballs.

3. The baseball training device of claim 1 wherein the frame means comprises tubular members that interconnect through male/female connectors.

4. The baseball mechanism of claim 1 wherein the catcher's mitt is hingedly attached to the frame member through a coaxial sleeve, including a set screw, whereby the catcher's mitt can be adjusted in height to simulate batters of various heights.

5. The baseball mechanism of claim 1 further including a home plate attached to the baseball mechanism by Velcro.

6. The baseball mechanism of claim 1 wherein the net means is attached using hook and eye means.

7. The baseball mechanism of claim 1 wherein the net means is attached using Velcro fasteners.

8. The baseball mechanism of claim 2 wherein the velocity meter is a radar gun.

9. A method of training a baseball pitcher utilizing the apparatus of claim 1 which simulates genuine pitching conditions and a genuine batter comprising providing the pitcher with a genuine catcher's mitt, hingedly supported to a frame member, behind an appropriately sized home plate, whereby a pitched baseball striking the catcher's mitt emits a sound that genuinely simulates a real pitched baseball, and measuring the velocity of the pitched baseball with a velocity meter.

* * * * *